United States Patent [19]

Kosmala

[11] 4,351,153

[45] Sep. 28, 1982

[54] HYDRAULIC CONTROL DEVICE

[76] Inventor: Rupert M. Kosmala, 76, Sutton Rd., London N10 1HG, England

[21] Appl. No.: 8,768

[22] Filed: Feb. 2, 1979

Related U.S. Application Data

[63] Continuation of Ser. No. 771,355, Feb. 23, 1977, abandoned.

[30] Foreign Application Priority Data

Mar. 5, 1976 [GB] United Kingdom ..... 9041/76

[51] Int. Cl.[3] ..... F01B 7/00; F15B 7/00; F15B 15/18

[52] U.S. Cl. ..... 60/581; 60/593; 92/151

[58] Field of Search ..... 60/581, 593

[56] References Cited

U.S. PATENT DOCUMENTS

| | | | |
|---|---|---|---|
| 2,499,563 | 3/1950 | Bill | 60/581 |
| 2,747,372 | 5/1956 | York | 60/581 |
| 3,021,678 | 2/1962 | Pagley | 60/581 |
| 3,914,942 | 10/1975 | Bacardit | 60/581 |

FOREIGN PATENT DOCUMENTS

| | | | |
|---|---|---|---|
| 1555751 | 4/1970 | Fed. Rep. of Germany | 60/581 |
| 319761 | 1/1972 | U.S.S.R. | 60/581 |

*Primary Examiner*—Paul E. Maslousky

*Attorney, Agent, or Firm*—Scrivener, Clarke, Scrivener and Johnson

[57] ABSTRACT

A hydraulic control device including an assembly of two or more pistons connected to move together within the same or different cylinders. The movement of the piston assembly causes each piston to displace corresponding amounts of hydraulic fluid from the associated cylinder, the fluid being used to operate hydraulic units, the latter being operated to the same extent irrespective of the loading thereupon.

5 Claims, 3 Drawing Figures

HYDRAULIC CONTROL DEVICE

This is a continuation of application Ser. No. 771,355, filed Feb. 23, 1977, now abandoned.

BACKGROUND OF THE INVENTION

1. Field of the Invention

This invention relates to hydraulic control devices.

In particular but not exclusively the present invention is concerned with hydraulic control devices which are applicable to the control of a plurality of fluid responsive units from a common fluid pressure source.

2. Description of the Prior Art

It is often desirable to be able simultaneously to exert by means of hydraulic devices displacement forces against a body which it is desired to move. In practice, the necessary displacement forces are frequently produced by separate hydraulic units such as rams under the control of pressure fluid from individual sources and under the control of separate and individually operable control elements. Alternatively, hydraulic rams are engaged with the body to be displaced and the operation of the rams is synchronised as far as possible by operating the controls as far as possible simultaneously.

In practice, the desired simultaneous operation is not produced with the result that the separate hydraulic units do not operate together so that the body to be moved is subjected to uneven displacement forces thereby leading to the possibility that the body will not be moved as required.

SUMMARY OF THE INVENTION

According to a first aspect of the invention there is provided a hydraulic system including means defining two or more outputs of fluid, and means for producing volumetric displacement of fluid from said outputs, which displacements are independent of fluid pressure conditions at said outputs.

The fluid outputs are preferably controlled by one or more linearly directed forces. Conveniently these linearly directed forces are fluid, mechanical or a combination of fluid and mechanical forces. The linear forces can be produced by means of piston and cylinder assemblies, screw jacks or other conveniently produced force acting linearly.

In a convenient arrangement the fluid outputs include cylinders having pistons whose rods are arranged to be actuated by or are mounted on a common actuating member, and for example, the arrangement can include two pistons arranged to move together in cylinders to displace predetermined quantities of fluid. Preferably the quantities of fluids are equal.

In practice the arrangements of the piston and cylinders are such that out of balance loads are not imposed upon the common actuating member.

In one such arrangement the avoidance of out of balanceloading is achieved by positioning the cylinders coaxially and parallel and the pistons are interconnected by a piston rod extending through both cylinders. With this arrangement since the pistons are mounted on a common piston rod they will move in unison. The amounts of fluid displaced by the pistons. always bears a constant relation to each other.

In an alternative arrangement where there are piston rods connected at points on an actuating member at different positions remote from the linear force, there are an even number and they are connected in pairs in such a way as to form a hydraulically balanced arrangement. Thus the cylinders may be arranged in pairs with each cylinder of each pair being of equal bore dimensions and each piston rod being arranged at an equal distance and in the opposite direction from the balance point or region, the outputs being connected in such manner that the resultant loads on the pairs of pistons will always act in balance with the linear force.

Where there are more than two output cylinders located at positions remote from the line of the linear force these cylinders are disposed in a similar manner although the bore sizes of each pair need not be the same as the bore sizes of another pair so long as the resultant force lies in the same position.

In practice the cylinders can be arranged in any desired configuration with respect to the line of the linear force for example in line or on a pitch circle.

BRIEF DESCRIPTION OF THE DRAWINGS

For a better understanding of the invention and to show how to carry the same into effect reference will now be made to the accompanying drawings, in which.

DESCRIPTION OF THE PREFERRED EMBODIMENTS

Figure 1:
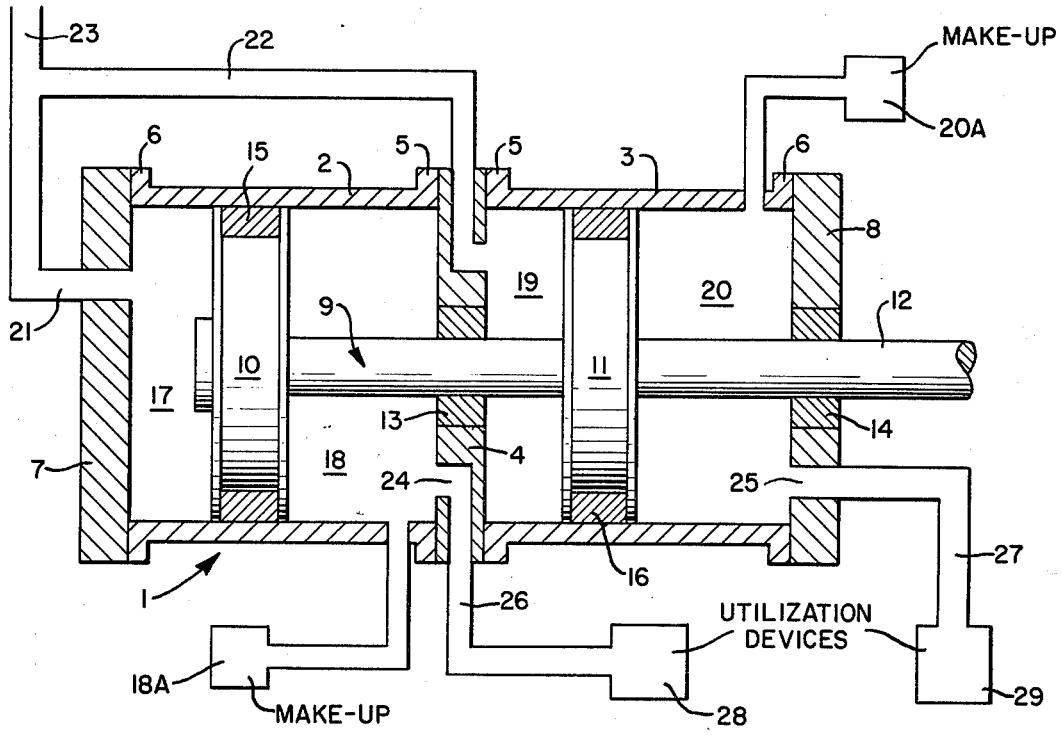
FIG. 1 is a cross sectional view of a first embodiment of a hydraulic device incorporating features of the present invention.

Referring now to FIG. 1 the device shown therein includes a piston and cylinder arrangement 1 which includes two similarly dimensioned co-axially arranged cylinders 2 and 3 which are connected in end-to-end relationship by way of a mounting plate 4.

The cylinders are conveniently provided with mounting flanges 5 which enable their interconnection with the plate 4. The opposite ends of the cylinders 2 and 3 are like-wise provided with mounting flanges 6 for facilitating the mounting in a fluid tight manner end caps or plates 7 and 8 respectively. It will be understood that the mounting flanges 5 and 6 can be constituted by annular flanges which are welded or otherwise attached to the cylinders and which are threaded so as to be engageable by complementary threaded parts of the plates 4,7 and 8.

A piston structure 9 including two pistons 10 and 11 carried upon a common piston rod 12 is slidable within the cylinder structure with the pistons 10 and 11 respectively co-operating with the cylinders 2 and 3. That part of the piston rod located between the two pistons passes through the plate 4 by way of a high pressure fluid sealing means 13 mounted in the plate 4. The piston rod 12 is illustrated as projecting outwardly of the cylinder 3 through the plate 8 and by way of a suitable high pressure fluid sealing means 14. Piston ring arrangements 15 and 16 are respectively provided on the pistons 10 and 11.

As will be seen from the drawing the arrangement of the cylinders and pistons and the plates defines four chambers 17,18,19 and 20. Pressure fluid ducts 21 and 22 respectively connect the chambers 17 and 19 to a pressurised fluid supply line 23 whereby the pressurised fluid can be delivered simultaneously to both of the chambers 17 and 19 to cause the pistons to move towards the right as can be seen from the Figure.

The chambers 18 and 20 are provided with fluid outlet ducts 24 and 25 respectively, the ducts respectively passing through the plates 4 and 8 to connect with fluid pressure lines 26 and 27. These lines 26 and 27 are respectively connected with hydraulic units 28 and 29 the latter being the units it is required to operate. The units 28 and 29 can be hydraulic rams or any other fluid operatable unit or means it is desired to actuate.

In operation, on applying pressurised fluid to the fluid line 23 pressurised fluid is introduced into the chambers 17 and 19 and acts upon the pistons 10 and 11 to urge them towards the right hand end of the cylinder arrangement and thereby displace fluid from the chambers 18 and 20 through the ducts 24 and 25 into the lines 26 and 27 so as to operate the associated hydraulic units 28 and 29.

In the above description fluid conduits and other arrangements necessary for introducing fluid into and maintaining fluid within the chambers 18 and 20 have been schematically shown at 18A and 20A.

As the diameters of the cylinders 2 and 3 are the same the quantities of fluid displaced through the outputs is the same. Consequently the hydraulic units 28 and 29 connected with the outputs 24 and 25 are subjected to the same amount of hydraulic fluid input. Thus in the case where the units 28 and 29 are hydraulic rams the latter will operate in unison irrespective of any load which may be applied to the individual rams.

In other words even if the loading on the hydraulic rams is unequal the rams will operate together, whereas in situations in which the rams are supplied from a common source the ram operation would be a function of the loading against which the ram operates. Thus a lesser loaded ram would be moved more lightly than a more heavily loaded ram. In extreme cases of such a situation only the lesser loaded ram would operate.

It will be further understood that the above described apparatus involves only two pistons. If desired more than two pistons could be used, the requisite number of plates and outputs being provided together with additional pressurised fluid inlets.

If in any particular application it is not thought necessary to apply pressurised fluid to the rear of the piston or any additional pistons, the associated fluid inlets can be omitted.

Figure 2:
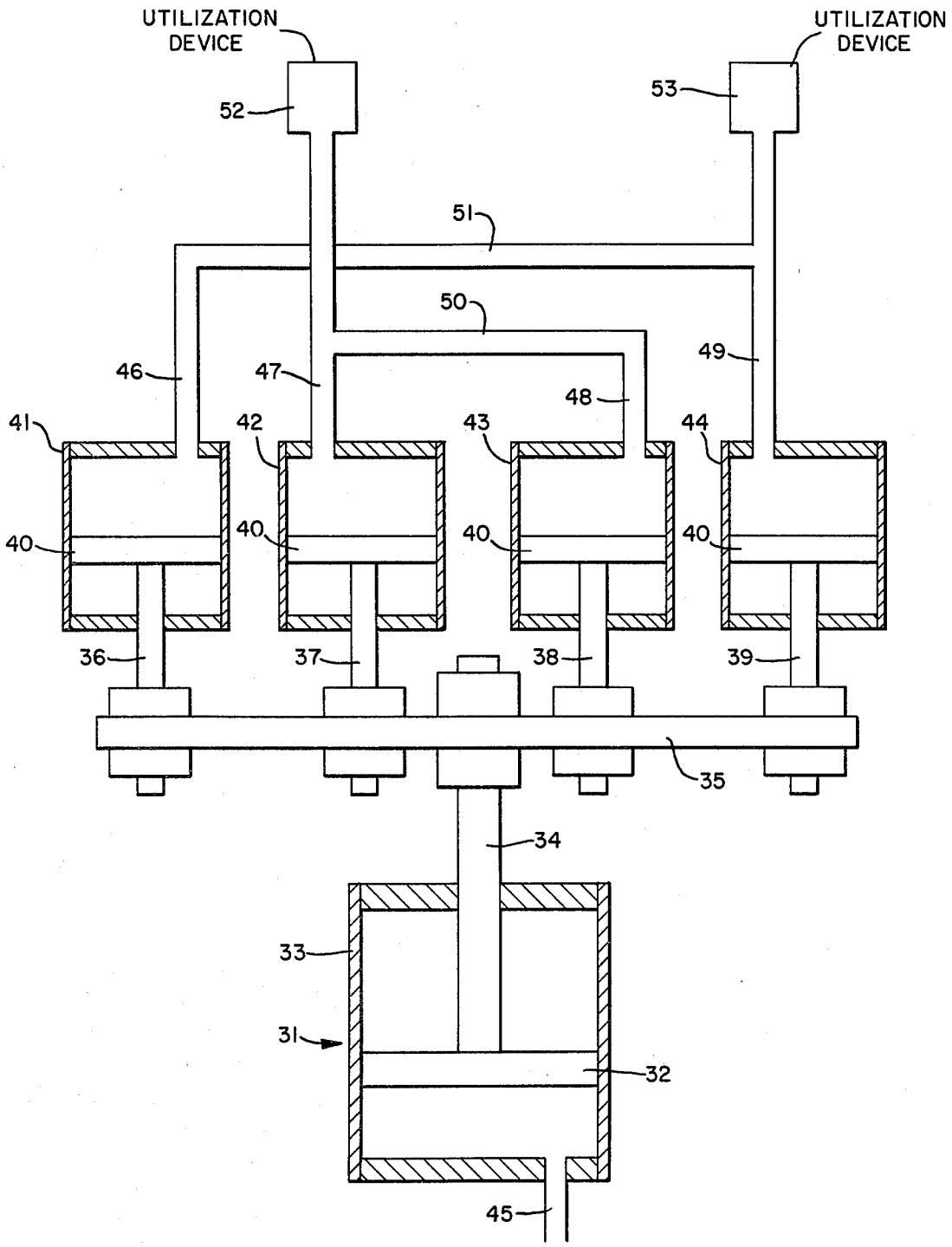
FIG. 2 is a cross sectional view of a further embodiment of hydraulic apparatus incorporating features of the invention.

A further embodiment of the invention is shown in FIG. 2. This embodiment includes a main piston and cylinder arrangement 31 including a piston 32 movable within a cylinder 33. The piston is mounted upon a piston rod which extends from the cylinder to provide an actuating or operating member 34 which is connected with a transverse bar or plate 35. Four piston rods 36,37,38 and 39 are connected to and are positioned along the bar 35, the rods carrying pistons 40 which respectively operate within cylinders 41,42,43 and 44. These cylinders are positionally fixed with respect to the cylinder 31. Since it is intended that the piston rods and associated cylinders are to be operationally related in pairs with each such pair including a piston and associated cylinder, the rod 36 is spaced from the member 34 by the same distance as the rod 39. A similar relationship exists between the rods 37 and 38.

With this arrangement, as the piston 32 is displaced by the action of pressurised fluid introduced through an inlet 45 the bar 35 moves therewith and the pistons 40 are moved in unison within their respective cylinders 41 to 44 by the same amount. When the cylinders 41 to 44 have the same bore dimensions the swept volumes of fluid displaced will be the same for all of the cylinders.

The cylinders 41 to 44 have fluid outputs 46 to 49 respectively. To obtain a balanced output condition lengthwise of the bar 35 the outputs of the cylinders 41 to 44 are connected in pairs such that the associated cylinders of a pair a symmetrically spaced to either side of the axis of the member 34. Thus the outputs 47 and 48 of the cylinders 42 and 43 are connected to a common output line 50 whilst the outputs 46 and 49 of the cylinders 41 and 44 are connected to a common output line 51. The output lines 50 and 51 are respectively connected to the hydraulic units 52 and 53 which are to be actuated in unison.

With the above described arrangement it will be seen that the resultant reaction forces imposed upon the pistons 40 by the hydraulic units 52 and 53 will be evenly distributed with respect to the member 34.

In relation to the above described embodiment it will be apparant that whilst those cylinders that are connected with a common output line must be of similar dimensions so that the swept volumes are the same, the dimensions from cylinder pair to cylinder pair can vary so as to obtain differing swept volumes and thus different but related outputs as a consequence of the pressurised fluid applied to the main piston and cylinder arrangement.

The linear arrangement of the auxilary cylinders 41 to 44 shown in FIG. 2 can be replaced by a non-linear arrangement of the auxilary pistons and cylinders by replacing the bar with a plate which allows the auxilary pistons and associated cylinders to be placed at required locations on the plate. The pistons are arranged in associated pairs such that the centre of a line joining the axes of the associated piston rods passes through the axis of the operating member 34.

The plate can be rectangular, circular or any other desired shape. In a particular arrangement of the auxilary cylinders they can be so located on the plate as to lie at opposite ends of the diameters of a circle, the centre of the latter co-inciding with the axis of the operating rod or element. The lines joining the associated pairs will in this case pass through the centre of the circle. Depending upon requirements said lines can be equiangularly disposed relative to each other or at various angles. In addition, the pairs of cylinders have to have the same radial separations. As mentioned above it is necessary to ensure that the cylinders forming a pair are equally radially spaced.

Figure 3:
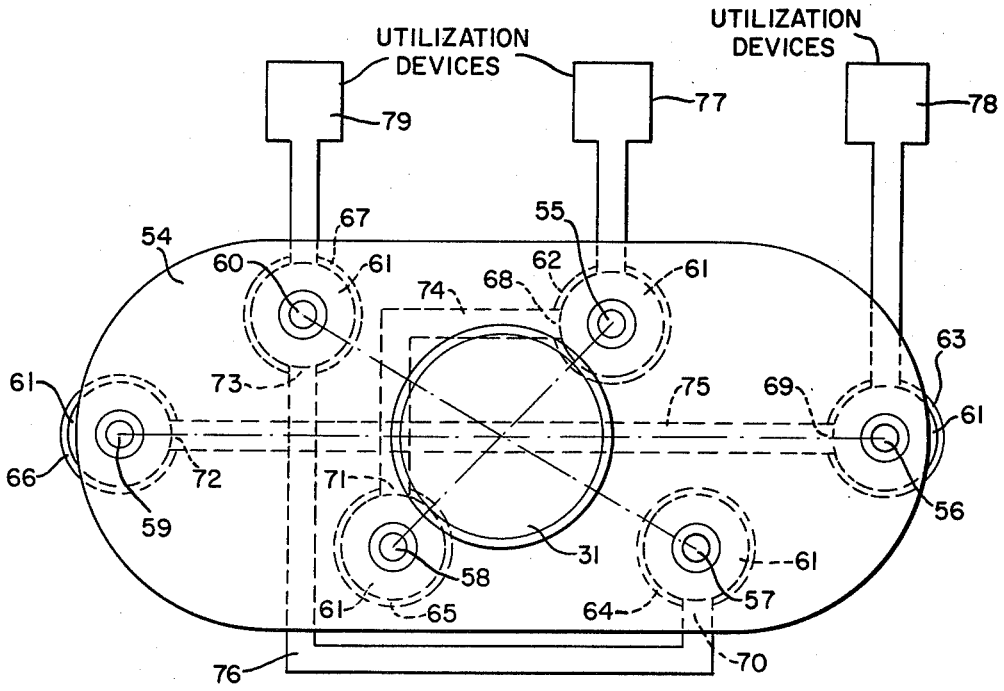
FIG. 3 is a view of a still further embodiment of hydraulic apparatus incorporating features of the invention.

FIG. 3 illustrates an embodiment in which the bar 35 has been replaced by a plate 54, the plate being of elongated form and having curved end portions. A main cylinder similar in function to the cylinder 31 of the FIG. 2 construction is identified in FIG. 3 as 31. A series of six auxilary piston rods 55 to 60 is connected to the plate 54. The upper ends of the rods 55 to 60 connect with pistons 61 which operate within cylinders 62 to 67. The piston rods 55 to 60 are arranged in associated pairs 55,58 56,59 and 57,60 so that the axes of the pistons of a pair are spaced the same distance from the axis of the cylinder 31. Conveniently the cylinders 62 to 67 have the same bore as is indicated in the Figures. The 62 to 67 are positionally fixed relative to the cylinder 31. The auxilary cylinders 62 to 67 have fluid outputs 68 to 73 respective. These outputs are interconnected in such manner that the outputs of associated pairs of the cylinders 62 to 67 are coupled to each other and to fluid output lines 74, 75 and 76. The associated pairs comprise cylinders 62,65 63,66 and 64,67. The output lines 74,75 and 76 are respectively connected to hydraulic units 77,78 and 79. It will be understood that by means of the various cylinder pairs and their interconnections with the output lines 74,75 and 76 the hydraulic forces are balanced with respect to the actuating member of the piston in the cylinder 31.

That is to say any hydraulic pressure exerted upon the pistons 61 by loading of the hydraulic units 77, 78 and 79 will be distributed through the actuating member 34.

In operation the application of a pressurised fluid to the main piston 32 will cause the latter to move the member 34 and thus the pistons 61 within the cylinders 62 to 67 and in so doing will displace fluid from the cylinders 62 to 67 through the outputs and associated output lines into the hydraulic units 77,78 and 79 to cause them to operate in unison.

In the above embodiments the means by which the piston assemblies of FIG. 1 and the actuating members of the apparatus of FIGS. 2 and 3 have been moved has involved the use of a pressurised fluid.

If desired, the respective movements of the piston assemblies or members can be effected mechanically by means of screw threaded operating heads which on rotation produce a corresponding movement of the associated piston assembly or operating member.

It will be understood that the constructional details of particular forms of the apparatus or devices of the invention will to a great extent depend upon the loads and pressures anticipated in use. That is to say when the apparatus or device is intended for use in lifting or moving very heavy loads the whole apparatus or device will clearly be of a robust character, whereas when the apparatus or device is required for lifting or moving relatively lighter loads the components of the apparatus or device can be of appropriately less robust dimensions.

Furthermore, the particular methods of constructing the apparatus or device such as, for example, that of FIG. 1 can be modified as thought expedient. Thus the cylinder and plates could be coupled together by arranging for the cylinder ends to engage in annular grooves in the plates and by providing tie bars to maintain the various parts in the desired positions.

As a further variation it is possible to replace the main piston and cylinder arrangement 31 and drive the auxilary pistons by means of separate feeds of pressurised fluid which is derived from a common source.

It should be noted that whatever the modification to the positioning of the auxilary pistons relative to each other it is important to maintain their balanced positioning so as to avoid out of balance forces acting upon the bar or plate or other support means to which the auxilary pistons are connected.

It will be apparent that the apparatus or device of the invention could in suitable circumstances be utilised in the opposite sense in that the hydraulic loading of the hydraulic units connected with the piston and cylinder arrangement outlets or outputs could be regarded as the source of power input to the apparatus or device. That is to say the pressures in the units act upon the auxilary pistons to move them in the reverse direction and thus correspondingly displace the actuating member or the pistons or both and thus displace pressurised fluid from the system. This displacement thus provides a means of providing an indication of the load producing the displacement of the pressurised fluid.

I claim:

1. A hydraulic fluid dispensing arrangement for dispensing predetermined volumetric quantities of fluid comprising a plurality of pairs of associated pistons and cylinders, each cylinder having a single fluid outlet, means mechanically coupling the pistons together, means for actuating the coupling means to produce a similar degree of motion of the pistons in their respective cylinders, said actuating means comprising a further piston acting in a main cylinder, and means for applying pressurized fluid to the main cylinder to move said further piston, said coupling means including a coupling member secured by a driving rod to said further piston, each pair of associated pistons respectively being coupled to the coupling member in symmetrically balanced relationship with respect to the driving rod, each pair of associated cylinders respectively having their fluid outlets combined, each of said combined outlets being separate from any other combined outlets and applied to a separate utilization device, whereby the forces acting on the coupling member upon operation of the actuating means are symmetrically balanced with resepct to said driving rod.

2. A hydraulic fluid dispensing arrangement for dispensing predetermined volumetric quantitites of fluid comprising a plurality of pairs of associated pistons and cylinders, each cylinder having a single fluid outlet, a coupling member rigidly coupling the pistons together, means for applying a force to one side of said coupling member along an axis symmetrical with respect to the axes of said cylinders to produce a similar degree of motion of said pistons in the respective cylinder means, each pair of associated pistons respectively being coupled to the coupling member in symmetrically balanced relationship with respect to the axis of said force applying means, each pair of associated cylinders respectively having their fluid outlets combined, each of said combined outlets being separate from any other combined outlets and applied to a separate utilization device, whereby the forces acting on the coupling member upon operation of the force applying means are symmetrically balanced with respect to the axis of the respective pairs of associated pistons and cylinders.

3. The hydraulic fluid dispensing unit of claim 2 wherein said coupling member comprises a rigid member normal to the axis of the force applying means and the axes of each pair of associated pistons connected to the coupling member are diameterically spaced equal distances on opposite sides of the axis of the force applying means.

4. The hydraulic fluid dispensing unit of claim 3 wherein all of said pistons are connected to said coupling member in linear disposition.

5. The hydraulic fluid dispensing unit of claim 3 wherein the coupling member comprises a rigid plate and the associated pairs of pistons are connected to said plate so that the center of a line joining the axes of each pair of associated pistons passes through the axis of the force applying means.

* * * * *